US009474376B2

(12) United States Patent
Drew

(10) Patent No.: US 9,474,376 B2
(45) Date of Patent: Oct. 25, 2016

(54) PORTABLE BACK PACK SWIVEL SEAT

(71) Applicant: Everitt Drew, Tallahassee, FL (US)

(72) Inventor: Everitt Drew, Tallahassee, FL (US)

( * ) Notice: Subject to any disclaimer, the term of this patent is extended or adjusted under 35 U.S.C. 154(b) by 0 days.

(21) Appl. No.: 14/470,211

(22) Filed: Aug. 27, 2014

(65) Prior Publication Data

US 2016/0058192 A1 Mar. 3, 2016

(51) Int. Cl.

| | |
|---|---|
| ***A47C 3/18*** | (2006.01) |
| ***A45F 3/08*** | (2006.01) |
| ***A47C 4/02*** | (2006.01) |
| ***A47C 7/00*** | (2006.01) |
| ***A47C 9/10*** | (2006.01) |
| *A45F 4/00* | (2006.01) |
| *A45F 4/02* | (2006.01) |

(52) U.S. Cl.

CPC . *A47C 3/18* (2013.01); *A45F 3/08* (2013.01); *A47C 4/02* (2013.01); *A47C 7/008* (2013.01); *A47C 9/10* (2013.01); *A45F 2004/006* (2013.01); *A45F 2004/026* (2013.01)

(58) Field of Classification Search

CPC ..... A47C 4/52; A47C 7/008; A47C 9/10; A47C 3/18

USPC ..... 297/17, 256.12, 445.1

See application file for complete search history.

(56) References Cited

U.S. PATENT DOCUMENTS

| | | | | | |
|---|---|---|---|---|---|
| 3,455,313 | A * | 7/1969 | King | A61H 3/00 | 135/67 |
| 4,777,973 | A * | 10/1988 | Nakajima | A61H 3/00 | 135/67 |
| 5,364,163 | A * | 11/1994 | Hardison | A47C 3/18 | 297/344.21 |
| 5,567,014 | A * | 10/1996 | Fitch | A47C 4/20 | 297/344.21 |
| 5,628,437 | A | 5/1997 | Kober | | |
| 6,453,921 | B1 * | 9/2002 | Rost | A61H 3/00 | 135/67 |
| RE39,022 | E | 3/2006 | Welsh | | |
| 7,052,080 | B2 * | 5/2006 | Knight | A45F 4/02 | 224/155 |
| 7,644,981 | B2 | 1/2010 | Hensley | | |
| 7,775,587 | B1 | 8/2010 | Reed | | |
| 2007/0187997 | A1 | 8/2007 | Smith | | |
| 2008/0179358 | A1 * | 7/2008 | Redzisz | A45F 4/02 | 224/155 |
| 2012/0286544 | A1 | 11/2012 | Cohen | | |

* cited by examiner

*Primary Examiner* — Sarah McPartlin

(74) *Attorney, Agent, or Firm* — William Hollimon

(57) ABSTRACT

A portable, swivel chair has a seat back and a seat bottom hingably joined and collapsible about the hinge, a swivel system positioned between the seat bottom and a seat bearing plate, and a mounting frame for the bearing plate that includes a pair of adjustable length seat legs. The swivel chair also includes a removable storage container positioned between the seat legs and accessible when a user is seated on the swivel seat. The adjustable length legs allow a user to choose a comfortable sitting height and to establish a level seating surface even on uneven or unlevel ground. A pair of backpack straps allow a user to transport the swivel seat in the manner of a backpack.

6 Claims, 10 Drawing Sheets

PORTABLE BACK PACK SWIVEL SEAT

CROSS-REFERENCES TO RELATED APPLICATIONS

This application claims priority under 35 U.S.C. §119(e) to U.S. Provisional Application Ser. No. 61/870,390 filed Aug. 27, 2013, by Everitt Drew, which is incorporated herein by reference in its entirety.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of portable seating devices. Specifically, the present invention is a portable, collapsible chair with a swivel seat and storage that may be transported in the manner of a backpack.

2. General Background

Hunters, birdwatchers, outdoorsmen, and other sports enthusiasts often have a need for a chair to sit it while in the wild or at other outdoor events. Traditional chairs are large, bulky, heavy, and simply not easy to transport or to use once in the field. Moreover, the portable chairs that do exist often lack a swivel seat that allows an outdoorsman to change his field of view without repositioning the chair itself and lack a seat back that allows for more comfort while seated. Additionally, convenient storage is frequently needed that is not always found in traditional seating. Finally, because the surfaces upon which an outdoorsman's chair is placed is often not level, and individuals desire to sit at different heights that are easily adjustable, the chair must be able to provide a flat, stable seating surface at various levels even when the underlying surface is not level. Thus, there is a need for a portable, collapsible chair, with a swivel seat, adjustable length legs, and storage, that may be worn like a backpack for transporting.

BRIEF SUMMARY OF THE INVENTION

The present invention provides a foldable chair generally comprising a lower frame and an upper frame, wherein the lower frame generally consists of a platform with two support members, or legs extending from two perimeters of the platform. The legs are in pairs and are either individual shafts joined into pairs or a U-shaped design. The U-shaped have the closed end of the U distant from the platform when deployed and the open ends of the U slidably connected to stub shafts that connect to the platform. The closed end of the U may further include a slight wave shape to facilitate placement against uneven surfaces. The leg pairs are individually adjustable in length, allowing variation for the disposed length of one or both legs. The legs making up the sides of the U are designed to slidingly engage a stub shaft. The position of each leg, with respect to the stub shafts it is engaged with, is controlled by an adjustment mechanism that allows and controls movement of the legs over the stub shafts.

This adjustment mechanism is comprised of a cylinder that connects between the open ends of the U towards the top of the legs. Inside the cylinder are positioned two rods, and two springs. The springs are centered in the cylinder and the rods connect to the springs and extend from the springs to just beyond the outer ends of the cylinder. A squeeze mechanism consisting of two handles connected to each longitudinal end of the spring extends external to the cylinder and allows the spring to be compressed, thereby retracting the two rods from a position just outside the cylinder to a position just inside of the cylinder.

The stub shafts and the legs have evenly spaced holes that have a diameter slightly larger than the diameter of the rods and that are alignable. Thus, the length of the support legs are adjusted by squeezing a pair of finger grips (this may be done using only one hand) which compresses the spring and retracts the rod and allows the legs to slide with respect to the stub shafts. Alternatively, the adjustment mechanism may be designed to be engaged through a twisting motion. Once the desired adjustment is achieved, the user aligns the holes in the legs with the holes in the stub shafts, and allows the spring to expand so that the rods are pushed through the holes and the length of the leg is established. The advantage over traditional height adjustment mechanisms is the ability to independently adjust the legs to the desired height using only one hand—instead of having to use two hands—and the ability to adjust to a variety of heights with one movement instead of multiple movements.

The upper half of the chair is connected to the lower half of the chair via a swivel system that allows the upper half to rotate 360 degrees with respect to the lower half of the chair. The upper half of the chair is comprised of a seat section and a backrest section. The seat section is connected to the swivel and is foldably attached to the backrest section along a rear edge of the seat section and a lower edge of the backrest section. The seat section is designed to allow space for the seat surface to depress when the seat is in use. Swivel stop straps prevent the swivel from engaging when the seat is collapsed for transport. Flexible support straps extend from the front sides of the seat section to the top sides of the rear section and limit the extent that the backrest can move away from the seat section. Backpack strap members attached to the frame allow the seat to be worn like a backpack when collapsed. Additionally, the chair may include a storage compartment/pack that is positionable under the support and between the legs. The storage compartment allows a user easy access to items stored therein while sitting. Additionally, the storage area may include storage pockets exterior to the compartment for additional storage.

In operation, a user collapses the backrest section upon the seat section, and retracts the legs. The backpack strap members are then engaged to allow easy transportation of the seat. Once a desired location is reached, the legs are extended as necessary to create the desired seating position and height and the backrest section is extended to the seating position. The user may then sit on the seat, and may swivel the upper half around the lower half and thereby change the field of view without the noise, disruption, and time of having to reposition the seat itself.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

REFERENCE NUMBERS INCLUDED IN THE DRAWINGS

The below table provides a ready reference for the reference numbers used in the appended drawings and in this specification:

| Ref. No. | Description | Ref. No. | Description |
|---|---|---|---|
| 100 | Swivel Seat | 101 | Backpack Strap |
| 102 | Connector Strap | 103 | Seat Back |
| 104 | Seat Tube Leg | 105 | Backpack Strap Connector |
| 106 | Storage Container | 107 | Storage Container Connector |
| 108 | Leg Length Adjustment System | 109 | Zipper |
| 201 | Seat Bottom | 202 | Seat Strap |
| 203 | Closure Tab | 301 | Seat Back Connector |
| 302 | Cross Bar | 303 | Side Frame |
| 304 | Bearing Plate | 305 | Seat Slide |
| 306 | Bushing | 307 | Bearing Plate Screws |
| 308 | Seat Bolt | 400 | Seat Frame |
| 401 | Adjusting Holes | 402 | Score Marks |
| 601 | Finger Grip | 701 | Guide Tube |
| 702 | Slide Bushing | 703 | Adjustment Rod |
| 704 | Spring | 705 | Spring Stop |
| 706 | Screw | 707 | Tube Hole |
| 801 | Finger Grip Slot | 1000 | Seat Structure |
| 1100 | Person | 1200 | Ground |

DETAILED DESCRIPTION OF THE INVENTION THROUGH THE DRAWINGS

Figure 1:
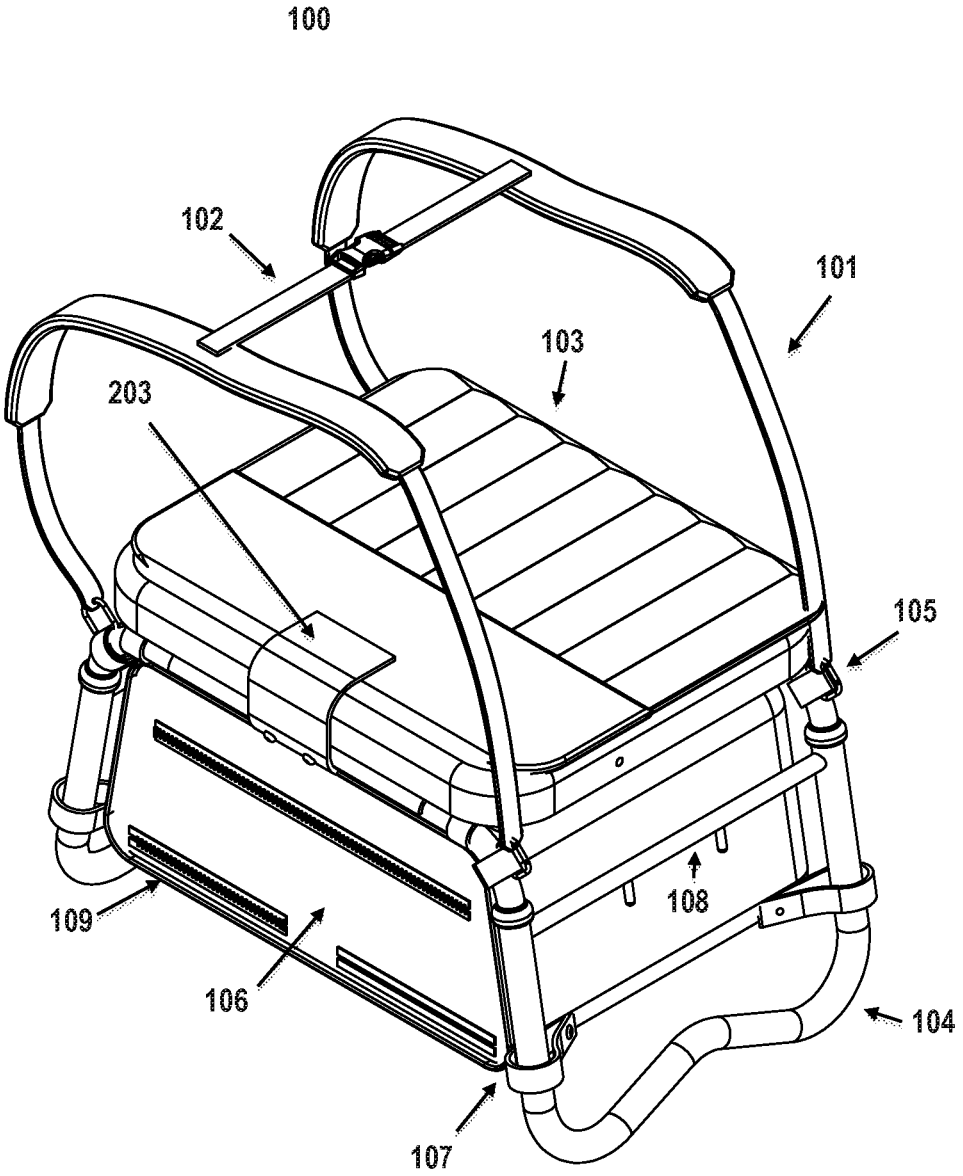
FIG. 1 is a side perspective view of the swivel seat of the present invention in a collapsed condition.
Figure 2:
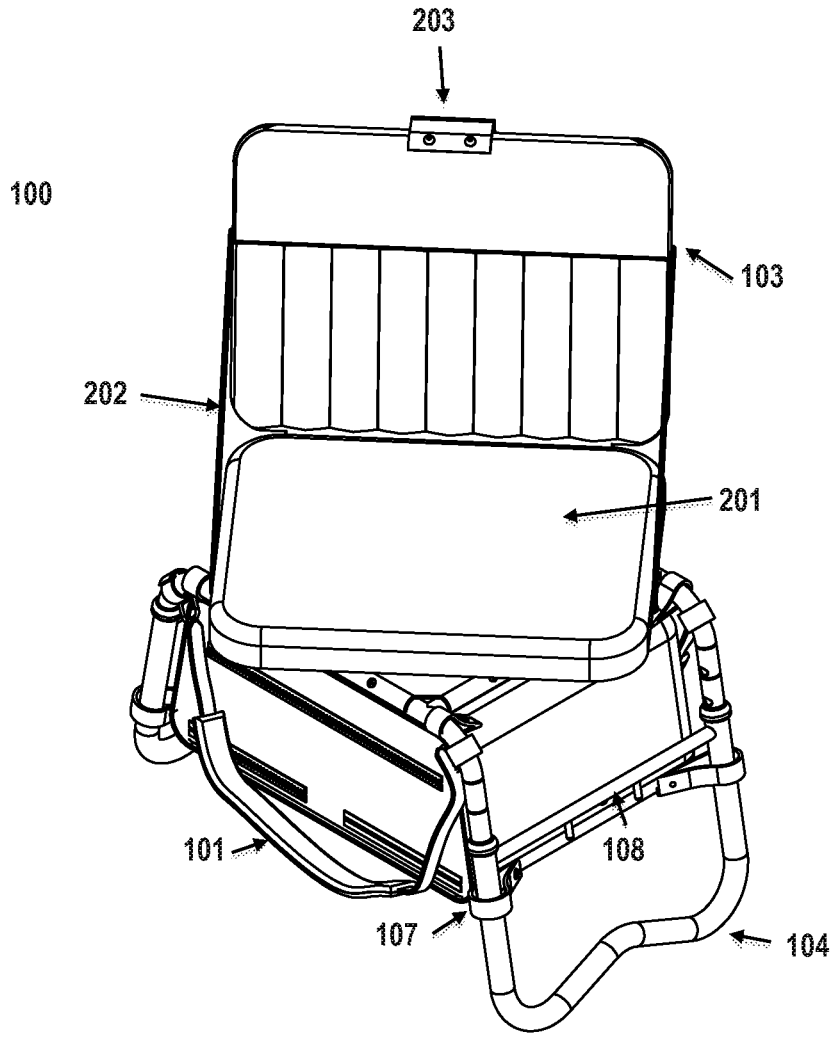
FIG. 2 is a side perspective view of the swivel seat of the present invention in a open condition.

Referring to FIG. 1, swivel seat 100 is shown with seat back 103 in a closed position, secured in place by closure tab 203. Further, as seen in FIG. 1, swivel seat 100 may be worn as a backpack, with a pair of backpack straps 101 facilitating this carrying arrangement. Connector strap 102 can be snapped together to maintain the relative positions of backpack straps 101 when worn as a backpack. FIG. 2 shows swivel seat 100 with seat back 103 in an open position, ready for a person to sit on swivel seat 100. Seat back 103 is hingedly connected to seat bottom 201 by seatback connector 301 (see FIG. 3) A pair of seat straps 202 connect between seat bottom 201 and seat back 103 and limit the amount of rotation about the axis created by seatback connector 301 to approximately 100 degrees. Seat straps 202 are flexible, strap connectors formed of nylon or other suitable material that is strong and light.

Figure 3:
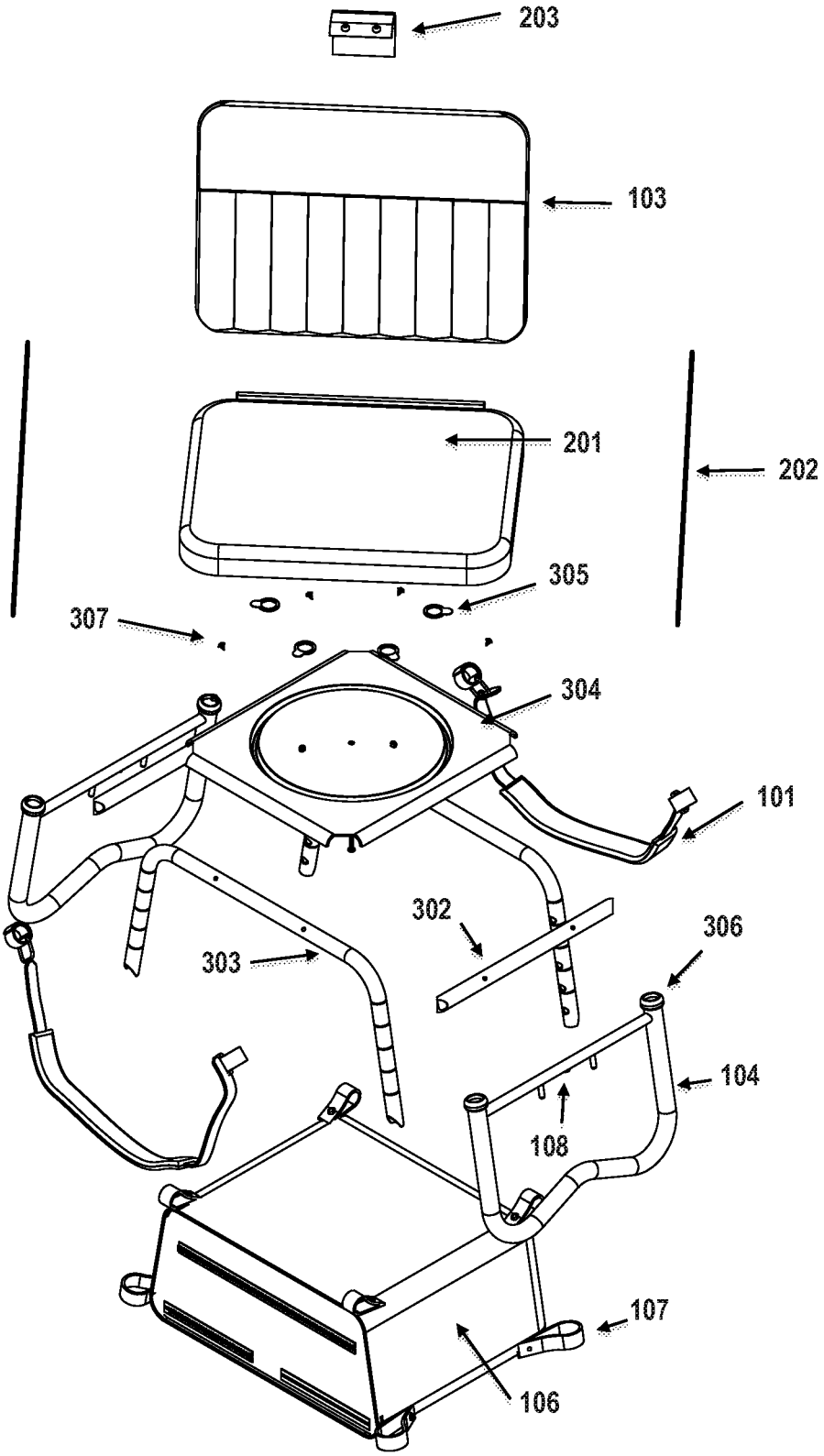
FIG. 3 is an exploded view of the swivel seat of the present invention; is a top, oblique view of the swivel seat of the present invention.
Figure 4:
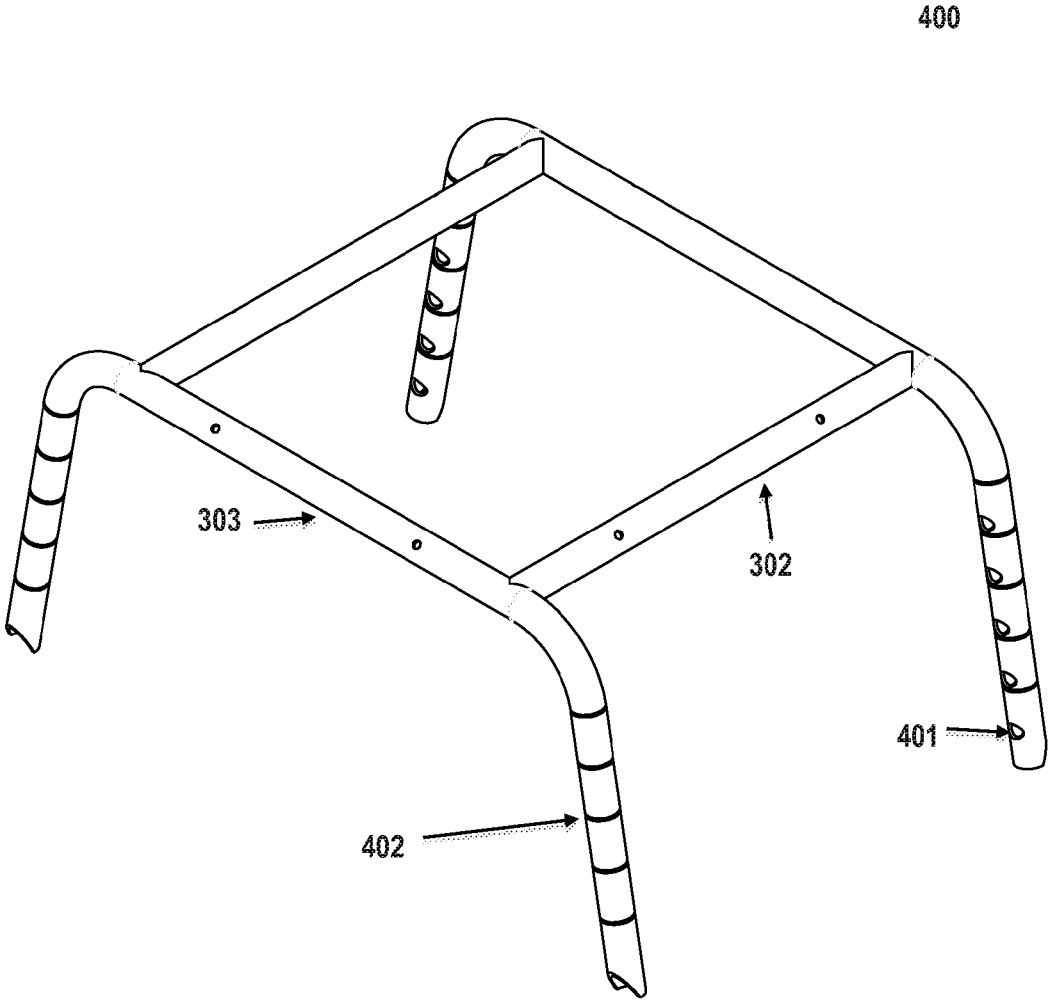
FIG. 4 is a side perspective view of the seat frame of the present invention.

FIG. 3 shows an exploded view of swivel seat 100. As seen in FIG. 4, seat frame 400 consists of a pair of side frames 303 that are connected by a pair of cross bars 302. Side frames 303 are U-shaped sections of tubing, with the open end of the U pointing down. Side frames 303 are formed from a light, strong metal such as aluminum, or may be formed from PVC pipe, or other structural tubing. Cross bars 302 are positioned so that, in combination with the upper portions of side frames 303, a mounting surface for bearing plate 304 (see FIG. 3) is created.

Figure 5:
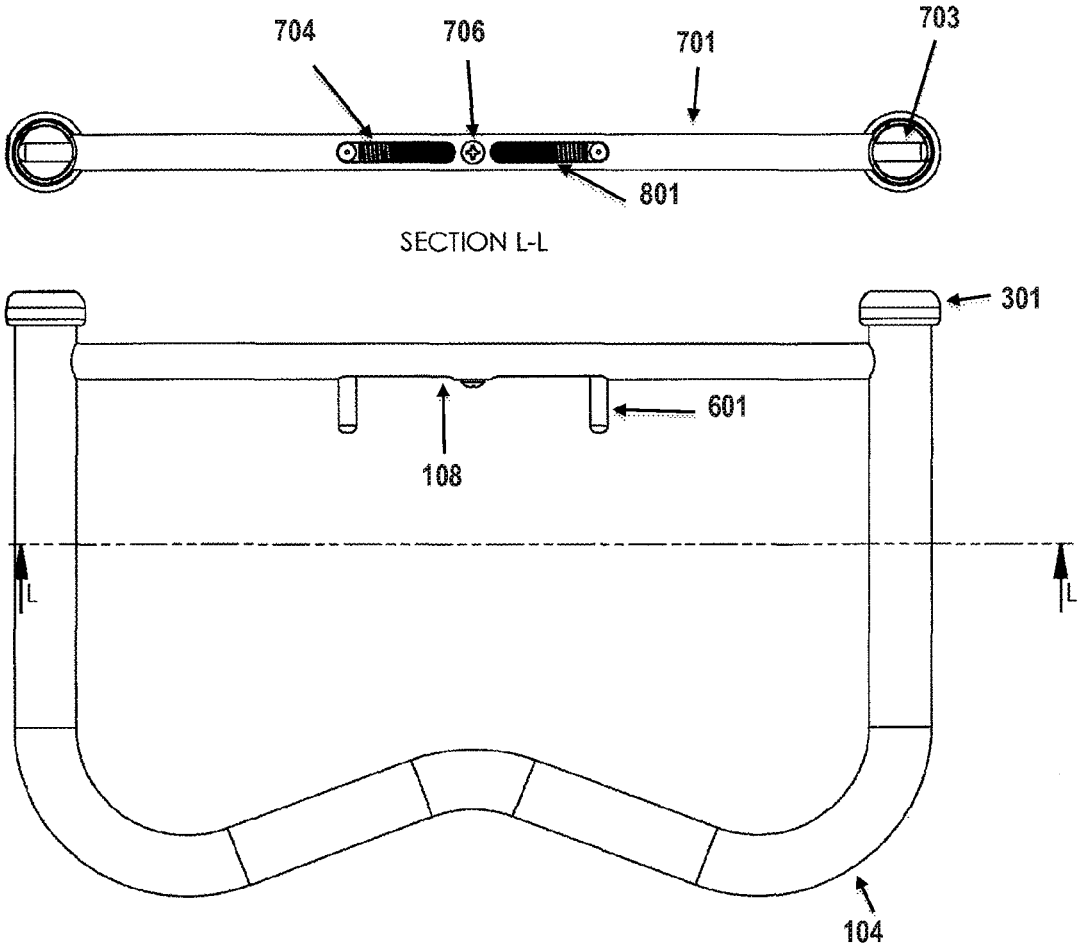
FIG. 5 is a side elevation view, including a sectional view, of the seat leg tube and leg length adjustment system of the present invention.
Figure 6:
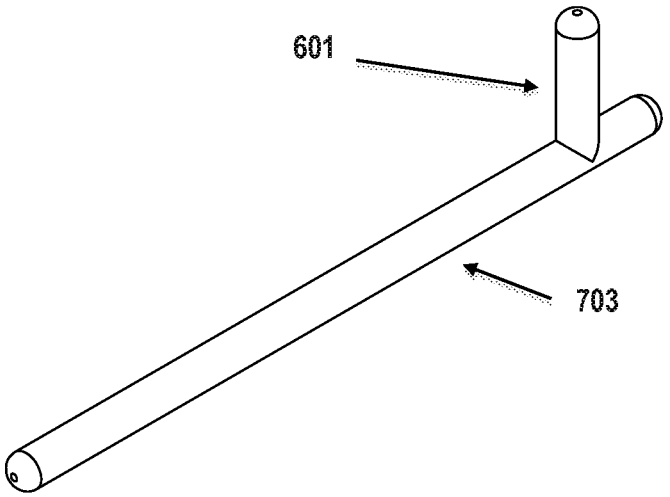
FIG. 6 is a side perspective view of the adjustment rod of the present invention.
Figure 7:
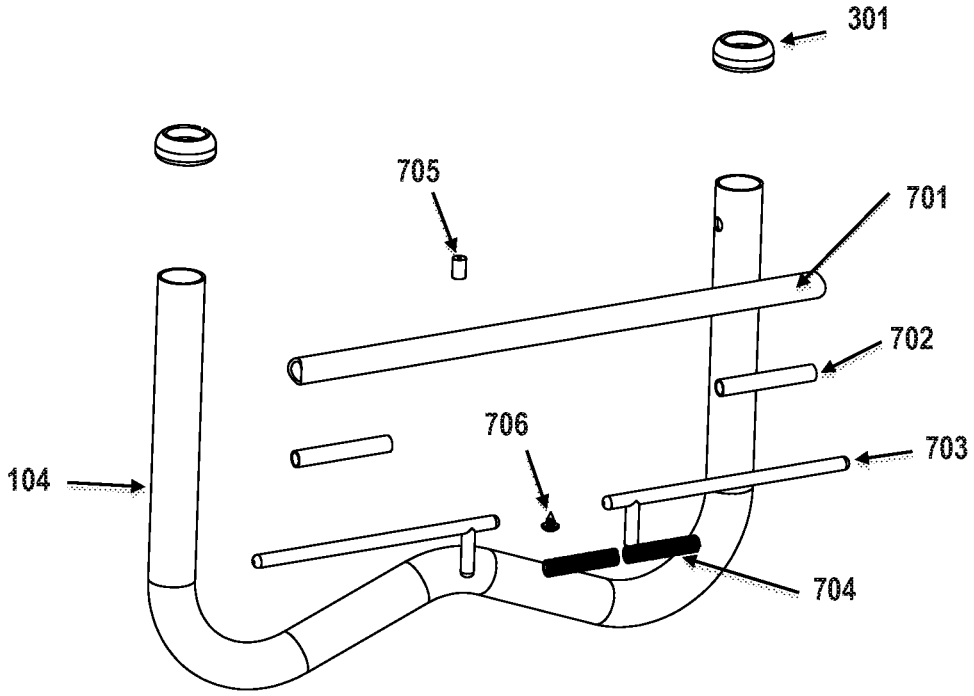
FIG. 7 is an exploded view of the seat leg tube and leg length adjustment system of the present invention.
Figure 8:
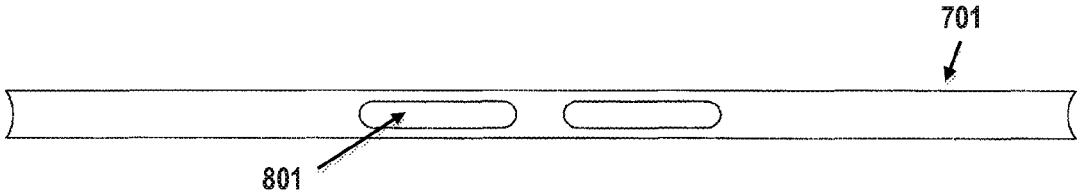
FIG. 8 is a bottom view of the guide tube of the present invention.
Figure 9:
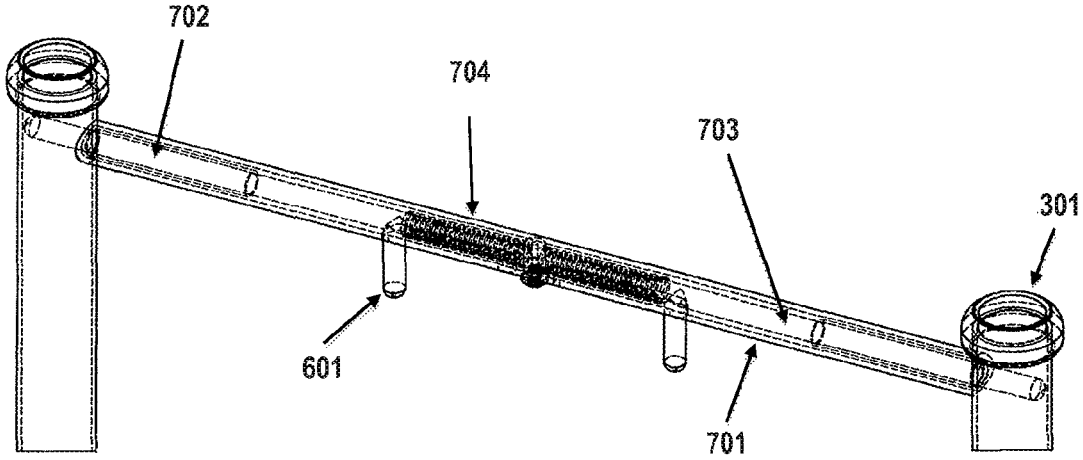
FIG. 9 is a perspective, sectional view of the seat leg tube and leg length adjustment system of the present invention.

The downward pointing portions of side frames 303 include a plurality of adjusting holes 401 and score marks 402. Adjusting holes 401 are used to adjust the effective length of the seat leg length created by the combination of side frames 303 and seat leg tubes 104 (see FIG. 3). Score marks 402 provide a ready reference for determining the seat leg length selected. FIG. 5 shows a side view and sectional view of seat leg tube 104 and leg length adjustment system 108. FIG. 7 shows an exploded view of seat leg tube 104 and leg length adjustment system 108. A pair of seat leg tubes 104 slidingly engage with the downward extending portions of side frames 303.

As seen in FIGS. 5, 6, 7, 8, and 9, leg length adjustment system 108 includes guide tube 701 which connects between the upward extending portions of seat leg tube 104. Disposed within guide tube 701 are a pair of adjustment rods 703, a pair of springs 704, a pair of slide bushings 702, and a spring stop 705. Adjustment rod 703 includes a downward extending finger grip 601, which extends through finger grip slot 801. As shown in FIG. 5, section L-L, adjustment rod 703 is disposed within guide tube 701 with its position within guide tube 701 biased by spring 704 such that the distal end of adjustment rod 703 extends through tube hole 707 and one of adjusting holes 401, thereby fixing the connection between seat leg tube 104 and side frames 303. By moving finger grips 601 towards each other against the bias created by springs 704, the distal ends of adjusting rods 703 are refracted through tube hole 707 and one of adjusting holes 401 thereby allowing seat leg tube 104 to slide with respect to side frames 303. Releasing finger grips 601 when tube hole 707 and one of adjusting holes 401 are aligned allows adjusting rod 703 to extend and fix the connection between seat leg tube 104 and side frames 303. Finger grip 601 are positioned so that a user may easily, with one hand, contact both finger grips 601 and through a squeezing motion, retract the distal ends of adjusting rods 703 and allow for the repositioning of seat leg tube 104 with respect to side frames 303. Similarly, releasing finger grips 601 allows the distal ends of adjusting rods 703 to fix the connection between seat leg tube 104 with respect to side frames 303. The movement of springs 704 is constrained by spring stop 705, which is secured in place by screw 706. Slide bushings 702 are positioned near the ends of guide tube 701, proximate to the upward extending portions of seat leg tube 104. Adjusting rods 703 slide within slide bushings 702.

Figure 10:
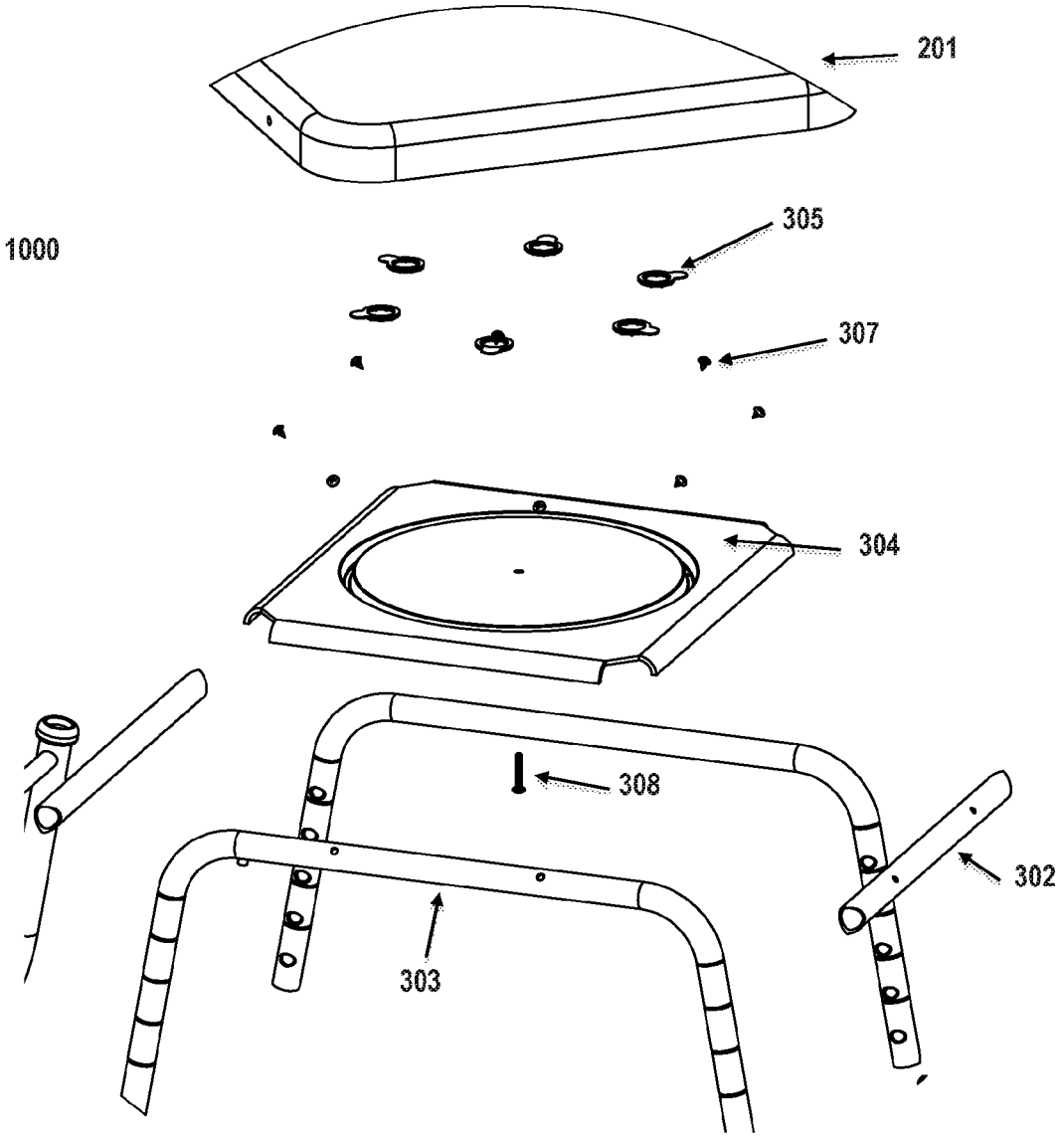
FIG. 10 is an exploded view of the seat structure of the present invention.

Referring to FIG. 10, an exploded view of seat structure 1000 is shown. Seat bottom 201 is preferably rectangular in shape and includes a padded upper surface and a hard lower surface (not shown) formed from a durable plastic, wood, or composite material, such as high density polyethylene, that is also weather resistant. A plurality of seat slides 305 are attached to the bottom surface (not shown) of seat bottom 201. Preferably, at least six seat slides 305 are positioned to define a circular shape. Seat bottom 201 is attached to bearing plate 304 by seat bolt 308. Optionally, the upper surface of bearing plate 304 may be covered with a thin sheet of low friction material such as nylon to facilitate sliding between bearing plate 304 and seat slides 305. Seat bolt 308 extends through the center of bearing plate 304 into the center of seat bottom 201 and prohibits vertical movement of seat bottom 201 while allowing seat bottom 201 to slidingly engage with bearing plate 304 via seat slides 305. Seat bottom 201 rotates about the vertical axis formed by seat bolt 308. Seat slides 305 include a low friction nylon or polymer material that supports and provides the contact surface between seat bottom 201 and bearing plate 304. Seat slides 305 allow seat bottom 201 to rotate about the vertical axis defined by seat bolt 308. Seat slides may also be in a variety of shapes that allow for efficient sliding between the slides and the bearing plate. Alternatively, a standard, circular ball bearing system may be employed to allow rotation between seat bottom 201 and bearing plate 304.

Bearing plate 304 is supported by, and attached to, a pair of side frames 303 and two crossbars 302, where crossbars 302 connect between side frames to create a structure to which bearing plate 043 is attached. Each side frame 303 is generally U-shaped, positioned in an upside down U position, with the closed end of the U forming a support and connection point for bearing plate 304. Side frames 1 are structural tubing formed from aluminum, or other similar structural material such as HDP or PVC. As shown in FIGS. 1 and 2, the downward pointing ends of side frames 303 are slidingly engaged with a pair of seat leg tubes 104. Seat leg tubes 104 are structural tubing formed from aluminum, or other similar structural material such as HDP or PVC. Seat leg tubes 104 are generally U-shaped, with the closed end of the U including a wave form aspect that allows seat leg tubes 104 to contact irregular ground (not shown). The inner diameter of seat leg tubes 104 is slightly larger than the outer diameter of side frames 303, thus allowing a sliding connection between side frames 303 and seat leg tubes 104. Bushing 306 aides alignment of this sliding connection.

As shown in FIGS. 1 and 2, swivel seat 100 further includes a storage container 106. Storage container 106 creates a roughly rectangular volume that is disposed directly below seat bottom 201. Storage container 106 includes four storage container connectors 47 at the four corners of its top surface, and four straps 107 at the four corners of its bottom surface. These straps use a hook and loop or a snap-type fastening system that allows storage container 106 to be securely connected to side frames 303 and seat leg tubes 104. Storage container 106 is preferably formed from a weather resistant fabric and further includes one or more zippers 109 that allow access to the secure storage area within storage container 106. Alternatively, the container may be of formed from materials suitable for different uses, such as netting for use in or near water or wet areas, or an insulated material for hot/cold storage.

Figure 11:
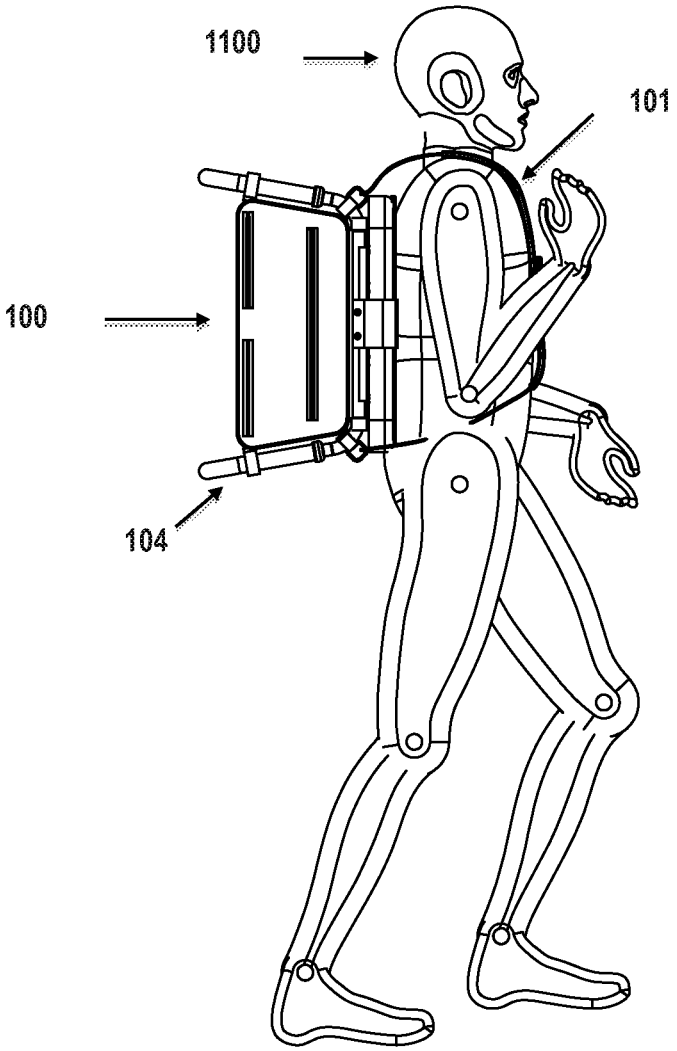
FIG. 11 is a depiction of a person carrying the swivel seat of the present invention in the manner of a backpack.
Figure 12:
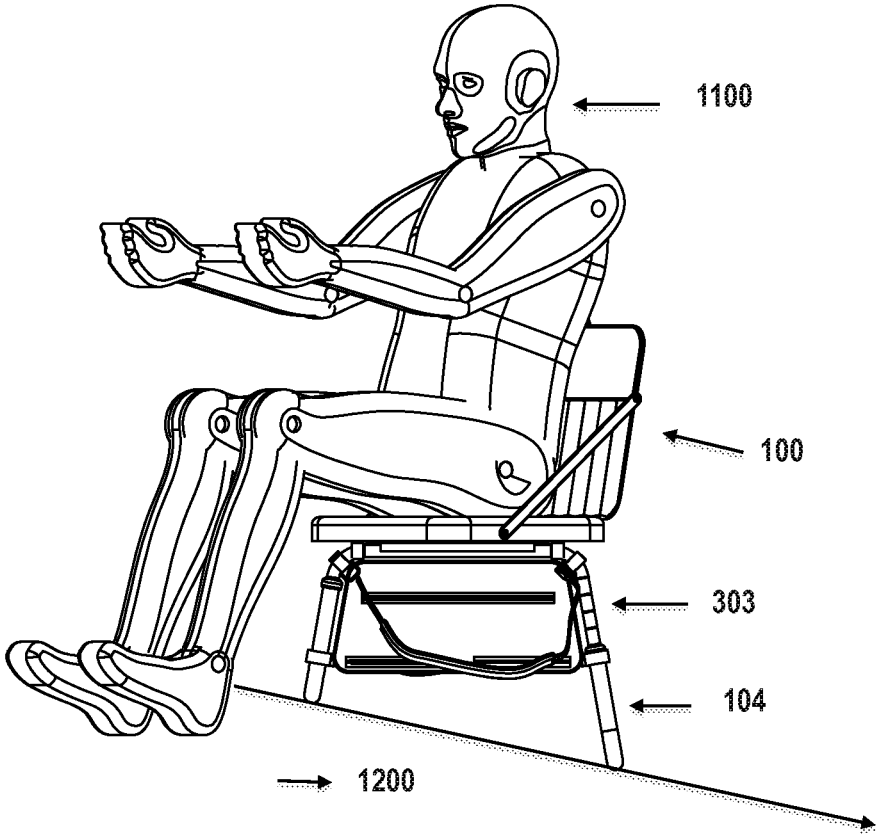
FIG. 12 is a depiction of a person sitting on the swivel seat of the present invention on unlevel ground.

As seen in FIG. 11, in operation, a person 1100 may utilize backpack straps 101 to carry swivel seat 100 to a desired outdoor location. Once at the location, as seen in FIG. 12, the person 1100 may use leg length adjustment systems 108 to independently adjust the positioning of seat leg tubes 104 with respect to side frames 303 to create a level seating surface even though ground 1200 is not level. Person 1100, using a single hand, may position a hand around finger grips 106 and through a squeezing motion overcome the bias created by springs 704, thereby retracting adjustment rods 703 and allowing sliding motion of seat leg tube 104 with respect to side frame 303. Releasing finger grips 106 then allows adjustment rod 703 to extend through tube hole 707 and one of adjusting holes 401 and thereby prevent additional sliding motion of seat leg tube 104 with respect to side frame 303. As seen in FIG. 12, Leg length adjustment systems 108 allow swivel seat 100 to be deployed to create a safe, comfortable, level seating surface even when deployed on an undulating, or otherwise unlevel surface. Releasing closure tab 203 allows a user to rotate seat back 103 into an upright position. The user may also store and retrieve items from storage container 106.

It will be readily seen by one of ordinary skill in the art that the present invention fulfills all the objects set forth above. After reading the foregoing specification, one of ordinary skill will be able to effect various changes, substation of equivalents and various other aspects of the invention as broadly disclosed herein. It is, therefore, intended that the protection granted hereon be limited only by he definition contained in the appended claims and equivalents thereof.

What is claimed is:

1. A portable swivel seat comprising:

a. a seat bottom;

b. a seat back hingedly connected to said seat bottom;

c. a bearing plate;

d. a plurality of seat slides disposed between said seat bottom and said bearing plate and wherein said seat slides are in direct contact with said seat bottom and said bearing plate;

e. a seat bolt, said seat bolt connecting said seat bottom to said bearing plate, said seat bolt further defining an axis of rotation about which said seat bottom may rotate on said seat slides;

f. a pair of side frames;

g. a pair of cross bars disposed between said side frames, wherein said side frames and said cross bars create a mounting structure for said bearing plate;

h. a pair of leg tubes, said leg tubes slidingly engaged with said side frames and wherein said side frames and said leg tubes create a pair of seat legs;

i. a pair of seat leg length adjustment mechanisms, wherein an amount of sliding engagement between said side frames and said leg tubes may be adjusted, and wherein each of said seat legs may have a different amount of said sliding engagement;

j. a storage container disposed below said bearing plate and removably attached to said side frames; and k. a pair of backpack straps removably connected to said side frames.

2. A portable swivel seat comprising:

a. a seat;

b. a pair of legs connected to said seat;

c. a swivel system allowing said seat to swivel with respect to said pair of legs;

d. a system for independently adjusting the length of each of said pair of legs, wherein said system includes a pair of retractable rods disposed within a guide tube and wherein said retractable rods are biased into an extended position by a pair of springs, and wherein said pair of springs is separated by a spring stop that may be retracted by a user using a squeezing motion of a single hand, and whereby said user may, using only said single hand, then adjust the length of each of said pair of legs.

3. The portable swivel seat of claim 2, wherein said swivel system includes a plurality of seat slides in direct contact with said seat.

4. The portable swivel seat of claim 3, wherein said plurality of seat slides are connected to said underside of said seat in a circular pattern.

5. A portable swivel seat comprising:

a. a seat swivably attached to a bearing plate;

b. a plurality of seat slides disposed directly between said seat and said bearing plate, whereby said seat slides provide a sliding engagement between said seat and said bearing plate;

c. said bearing plate attached to a seat support frame;

d. said seat support frame having a pair of u-shaped legs;

e. said pair of u-shaped legs slidingly connected to a pair of u-shaped leg tubes and forming a pair of seat legs;

f. a system for independently adjusting the effective length of each of said pair of seat legs whereby, said portable swivel seat may be disposed on an unlevel surface and maintain said seat in a level orientation.

6. The portable swivel seat of claim 5 wherein said system for independently adjusting the effective length of each of said pair of seat legs includes a pair of retractable rods disposed within a guide tube and wherein said retractable rods are biased into an extended position by a pair of springs, and wherein said pair of springs is separated by a spring stop.

* * * * *